US005752850A

United States Patent [19]

Ziegler

[11] Patent Number: 5,752,850

[45] Date of Patent: May 19, 1998

[54] ELECTRICAL CONNECTOR-REMOVING APPARATUS AND METHOD

[76] Inventor: Zelda Ziegler, 61589 Twin Lakes Loop, Bend, Oreg. 97702

[21] Appl. No.: 759,772

[22] Filed: Dec. 3, 1996

[51] Int. Cl.[6] ..... H01R 13/00

[52] U.S. Cl. ..... 439/484

[58] Field of Search ..... 439/484, 451, 439/483, 476.1, 692

[56] References Cited

U.S. PATENT DOCUMENTS

| | | | |
|---|---|---|---|
| 1,749,623 | 3/1930 | Zinman . | |
| 2,869,096 | 1/1959 | Miller . | |
| 2,977,564 | 3/1961 | Civitelli et al. . | |
| 2,986,719 | 5/1961 | Adams . | |
| 3,008,115 | 11/1961 | Oakes . | |
| 3,160,947 | 12/1964 | Sunderlin | 29/206 |
| 3,431,535 | 3/1969 | Munyan | 339/45 |
| 3,651,447 | 3/1972 | Branco et al. | 339/102 R |
| 4,042,292 | 8/1977 | Chensky | 339/45 R |
| 4,210,377 | 7/1980 | LaVoque | 339/45 R |
| 4,307,924 | 12/1981 | Gibbs | 339/110 P |
| 4,586,768 | 5/1986 | Eck | 339/45 M |
| 4,619,491 | 10/1986 | Drogo | 339/45 M |
| 4,702,537 | 10/1987 | Mattingly, et al. | 439/152 |
| 4,778,400 | 10/1988 | Jacobs | 439/152 |
| 4,857,013 | 8/1989 | Peters | 439/484 |
| 4,881,911 | 11/1989 | Haddock et al. | 439/484 |
| 5,062,803 | 11/1991 | Howard | 439/160 |
| 5,409,397 | 4/1995 | Karman | 439/484 |
| 5,516,305 | 5/1996 | Haluska | 439/484 |

*Primary Examiner*—Gary F. Paumen
*Assistant Examiner*—Yong Ki Kim
*Attorney, Agent, or Firm*—Foster & Foster

[57] ABSTRACT

Novel connector-removing devices and method are disclosed which facilitate the disconnection of a connector from a receptacle or another connector, the devices being capable of being wrapped around the connector to firmly hold the connector within the device. One connector-remover apparatus includes a band, a strap, and fasteners attached to the band and strap. The band may be firmly positioned about a connector by wrapping the strap around the band. In a preferred embodiment, the band has attached to its ends a tether to facilitate pulling the connector. Additionally, the band may have apertures formed in the face thereof for receiving the prongs of an electrical connector.

21 Claims, 6 Drawing Sheets

ELECTRICAL CONNECTOR-REMOVING APPARATUS AND METHOD

FIELD OF THE INVENTION

The present invention relates generally to removing devices for connectors, such as plugs, and, specifically, to devices and method for disconnecting electrical plugs from female electrical receptacles or sockets and other connectors from a connected relationship as well.

BACKGROUND

Male connectors, such as plugs or prongs, of a variety of types are used for the frictional coupling together of two items. Connectors can be used to cooperate with female sockets, receptacles, or other connectors to provide electrical and pneumatic communications.

Electrical connectors are devices that allow for easy frictional electrical coupling of an electrical cord to a socket, receptacle, or other electrical connector. A male electrical connector typically comprises a housing member which may support prongs extending from one end thereof that are frictionally accepted into an outlet, receptacle, socket, or other connector. Similarly, a female electrical connector may comprise a housing capable of frictionally receiving prongs extending from another connector.

The electrical cord is typically accepted through an aperture in the connector's housing member and wires or cables in the cord are appropriately connected to the prongs within the housing member. Moreover, electrical connector housing members are typically formed in a variety of shapes and are made from a variety of materials. Frequently, however, the housing member is of a relatively small size.

Due to the variety of shapes and often relatively small size of an electrical connector housing member, invariably it is difficult to properly disconnect and remove it from an outlet or other receptacle, especially if the connector is located in a difficult-to-access outlet or socket or where the outlet connection is stiff. Connector removal can be particularly difficult for people who have suffered a loss in motor function, dexterity, or strength due to causes such as stroke, carpal tunnel syndrome, or amputation.

Often, it is easier for a person to improperly disconnect a connector by simply grasping and pulling the electrical cord attached to the connector rather than by firmly gripping the connector housing and pulling the connector. However, this is an undesirable practice as the connections between the wires and the prongs can weaken, raising the probability that a disconnected or a broken strand of one wire may touch another wire and cause a short circuit within the connector. Additionally, the cord can be come completely detached from the connector.

The task of removing a connector from a receptacle is particularly cumbersome in situations where disconnection must occur on a regular or frequent basis. For example, it is commonplace for people to install an electric engine block heater to their cars. Typically, the electric block heater will comprise an internal probe and an external electrical connector, the electrical connector being typically accessible from the front of the car. To heat the engine block, the block heater connector is connected to a female power receptacle of a house by an extension cord having a male connector at one end thereof. It is often inconvenient for the user, on a daily basis, to manually disconnect the extension cord from the block heater connector by firmly gripping and pulling the connector housing to separate one from the other. This inconvenience is heightened when the disconnection must be performed in cold weather when the user is wearing gloves or mittens. It is exacerbated when the user must remain in the vehicle to keep it running.

An additional problem associated with the block heater electrical connection is that once the block heater connector is disconnected from the extension cord, it is often subject to the elements, such as wind and snow which can cause damage to the prongs of the electrical connector.

Further, connectors which are inserted in a receptacle having a spring-loaded face plate are particularly difficult to disconnect. This is especially so if the face plate has a latch hook thereon to prevent the inadvertent disconnection of the connector from the receptacle.

Prior attempts have been made to provide connector-removing devices and methods. However, such prior attempts have failed to provide an adequate connector-removing device. For example, prior connector-removing devices fail to hold the connector firmly in place within the device. Such loose connection between the device and the connector increases the difficulty of disconnecting the connector. Further, the existing connector-removing devices fail to provide a connector-removing device for a female connector. Having a connector-removing device on both the male and female connections in an extension cord/appliance cord connection significantly facilitates the disconnection of such cords from one another.

Additionally, in applications where the connector is likely to be subjected to adverse weather conditions, it is desirable to have a connector-remover with a sleeve which helps to protect the connector, especially the connector prongs, from the damaging effects of the weather. Prior attempts to provide connector-removing devices have failed to adequately solve this problem. Moreover, attempts to provide a connector-remover manufactured by plastic injection molding may be undesirable in that such a remover may lack low-temperature strength, and break or crack when used in low-temperature environments. Also, several prior attempts to provide connector pulling devices have required that the device be a current-carrying device. Such a current-carrying connector-removing device is undesirable in that it may be more expensive to manufacture and cumbersome to use. Lastly, the prior attempts to provide connector-removing devices have failed to provide a connector-removing device particularly adapted to accept the prongs and housing of a three-phase power connector.

For the foregoing reasons, a need for a connector-removing device which addresses the aforementioned problems has long existed.

BRIEF SUMMARY AND OBJECTS OF THE INVENTION

In brief summary, the present invention overcomes or substantially alleviates prior art problems related to the provision of connector-removing devices and methods. A connector-removing device embodying principles of the present invention comprises a band having apertures adapted to accept the prongs of a male electrical connector, the band having a band fastener attached thereto. A strap having a strap fastener attached thereto is also affixed to the band whereby the prongs of a connector may be inserted through the band apertures and the connector may be securely positioned in the connector-removing device by the strap being wrapped around the connector and attached to the band fastener by the strap fastener. In one embodiment, a tether is attached to the ends of the band to further facilitate pulling the connector. In another embodiment, a sleeve is affixed to the strap and sized to substantially cover the prongs of a male electrical connector when the strap is wrapped around the band's side portions. In yet another embodiment, the connector-remover does not connect to the face of the connector where the electrical connections are made nor does it have band apertures adapted to accept prongs; instead it is designed to pull from finger lugs formed on the connector housing. In yet another embodiment, a lifting lever is pivotally affixed to the connector-remover to aid in removing a connector from a receptacle having a spring loaded face cap with a latch disposed thereon.

It is a primary object to overcome or substantially alleviate problems of the prior art.

It is another primary object of the present invention to provide a novel and improved connector-removing device which overcomes or substantially alleviates problems associated with prior art connector-removers and methods of disconnecting connectors.

Another object of this invention is to provide a connector-removing device which firmly holds the connector within the device.

Another object of this invention is to provide a connector-removing device which is attachable to either the male end or the female end of a two-cord connection.

Another object of this invention is to provide a connector-removing device with a sleeve mounted thereon capable of protecting the connector from the environment.

Another object of this invention is to provide a connector-removing device which can be used in low-temperature applications.

Another object of this invention is to provide a connector-removing device which facilitates the disconnection of a engine block heater from an extension cord.

Another object of this invention is to provide a connector-removing device which need not be current-carrying.

Another object of this invention is to provide a method of affixing a connector-removing device to a connector.

Another object of this invention is to provide a method of disconnecting a connector from a receptacle having a spring-loaded face cap with a latch disposed thereon.

Another object of this invention is to provide a connector-removing device particularly adapted to accept the prongs and housing of a three-phase power connector.

Further objects and advantages of this invention will be apparent from the following detailed description of the illustrated embodiments.

BRIEF DESCRIPTION OF THE DRAWINGS

Preferred embodiments of the invention are described below with reference to the accompanying drawings.

DETAILED DESCRIPTION OF THE ILLUSTRATED EMBODIMENTS

Figure 2:
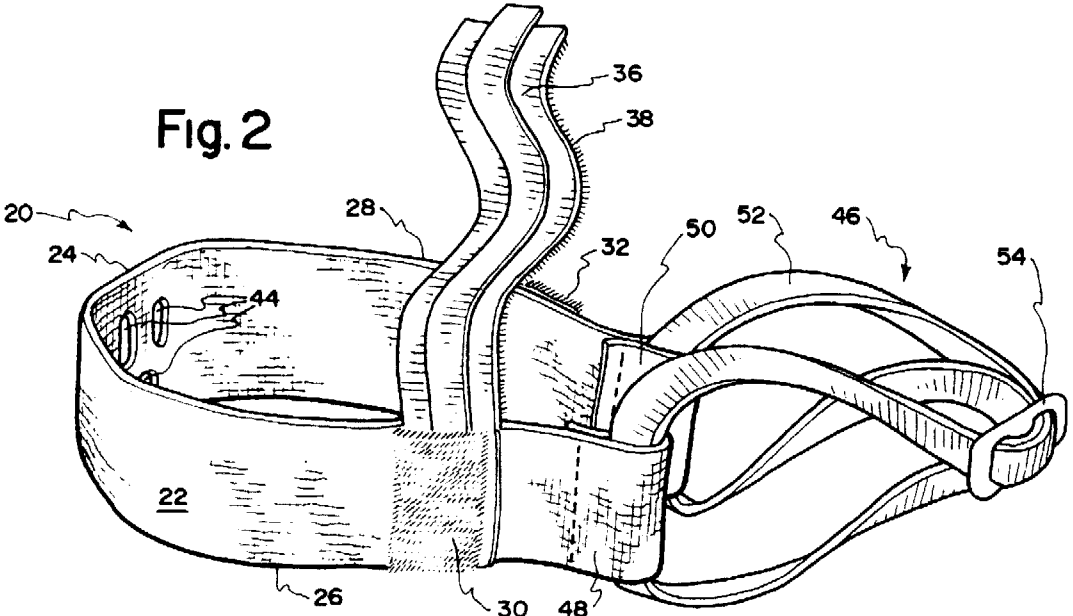
FIG. 2 is perspective of a connector-removing device without a connector inserted therein.
Figure 1:
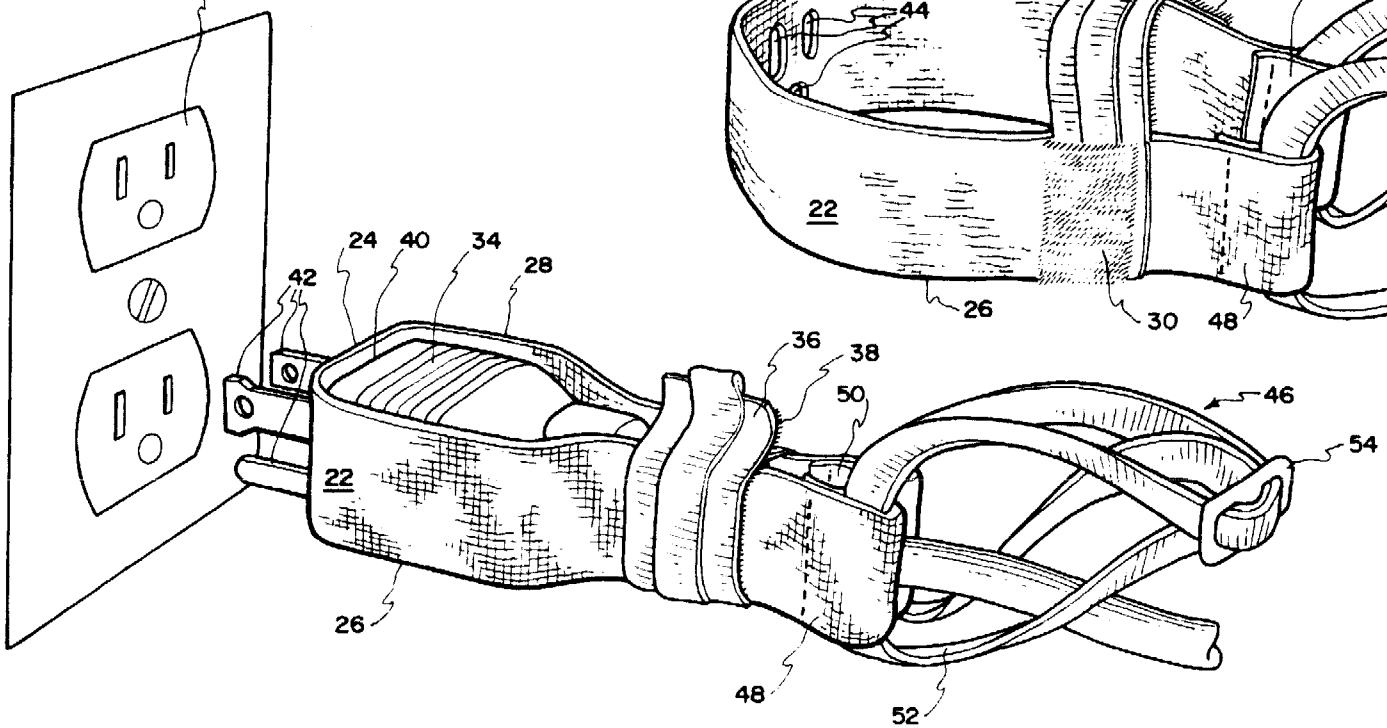
FIG. 1 is a perspective of a connector-remover embodying principles of the present invention affixed to an electrical connector and of an electrical wall receptacle.
Figure 3:
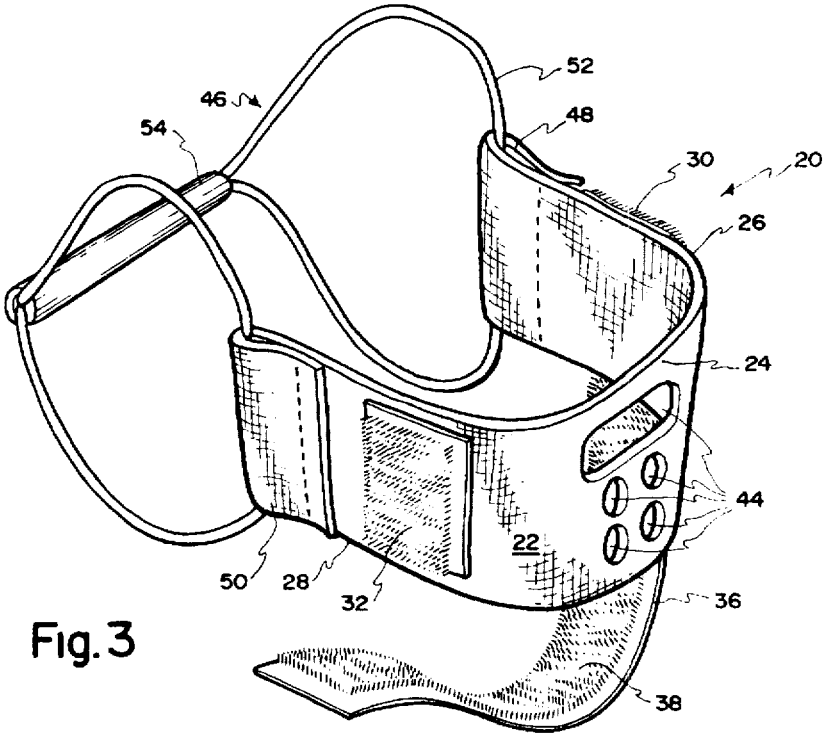
FIG. 3 is perspective of a connector-removing device for a six-pronged connector.
Figure 4:
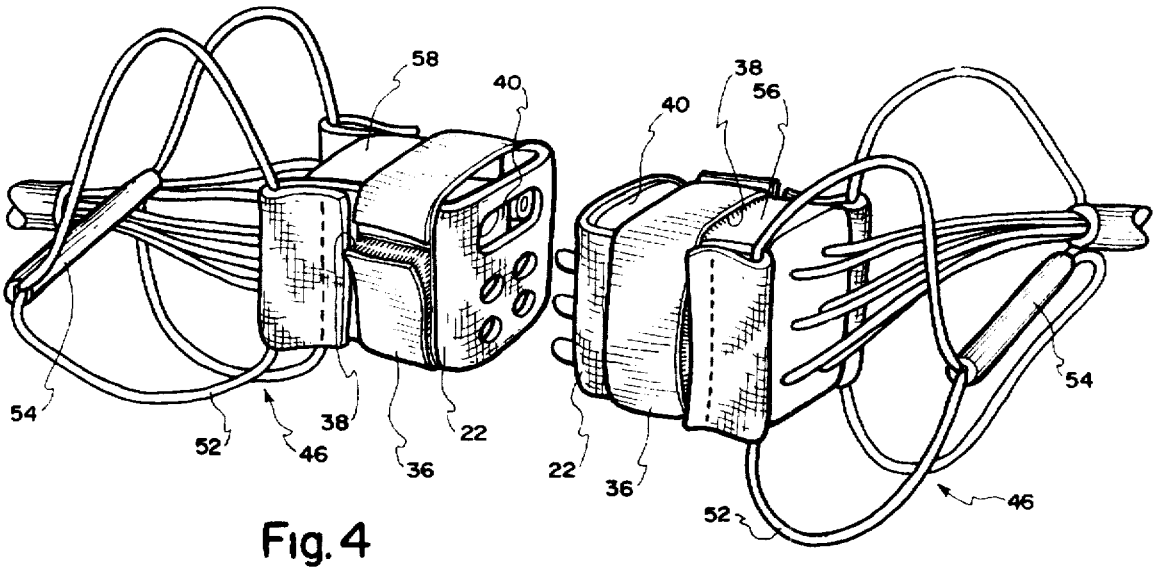
FIG. 4 is a perspective showing two six-pronged connectors each having mounted thereon the connector-removing device of FIG. 3.
Figure 5:
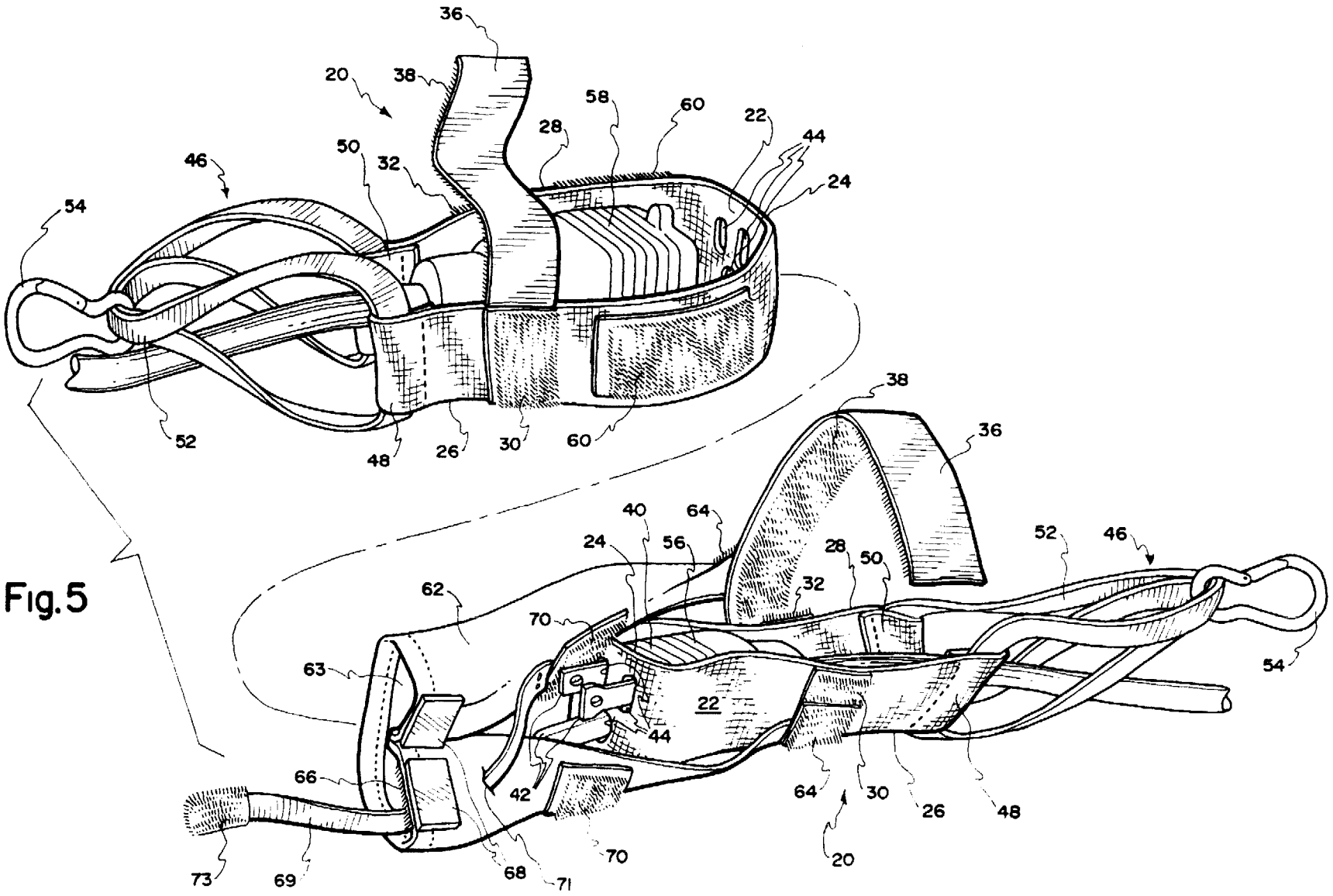
FIG. 5 is a perspective of a connector-removing device attached to a female connector and a connector-removing device having a sleeve attached to a male connector.
Figure 6:
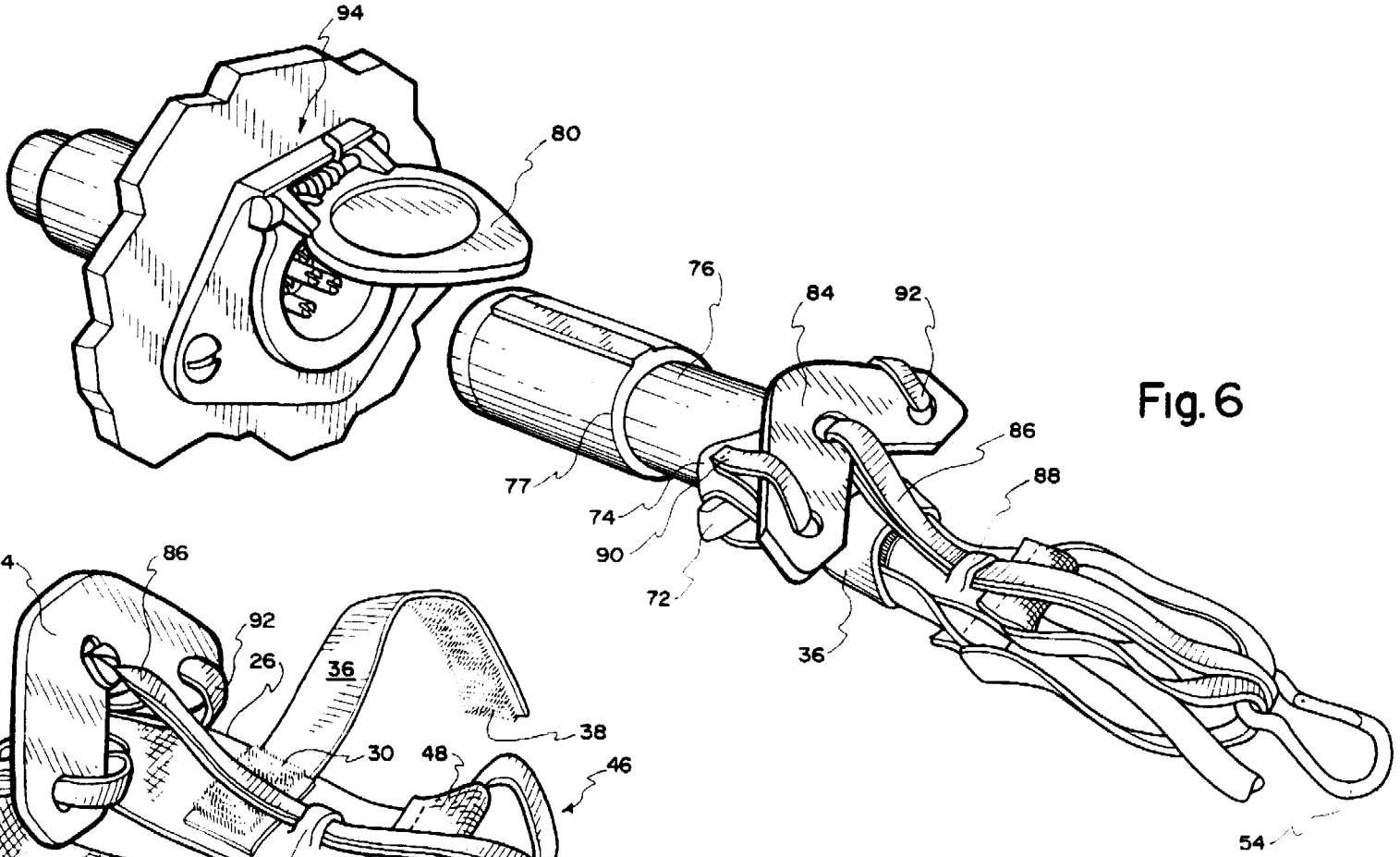
FIG. 6 is a perspective of a connector-removing device of the present invention which is attached to the finger lugs of the connector, the device having a lever attached thereto and a receptacle having a spring-loaded face cap attached thereto.
Figure 7:
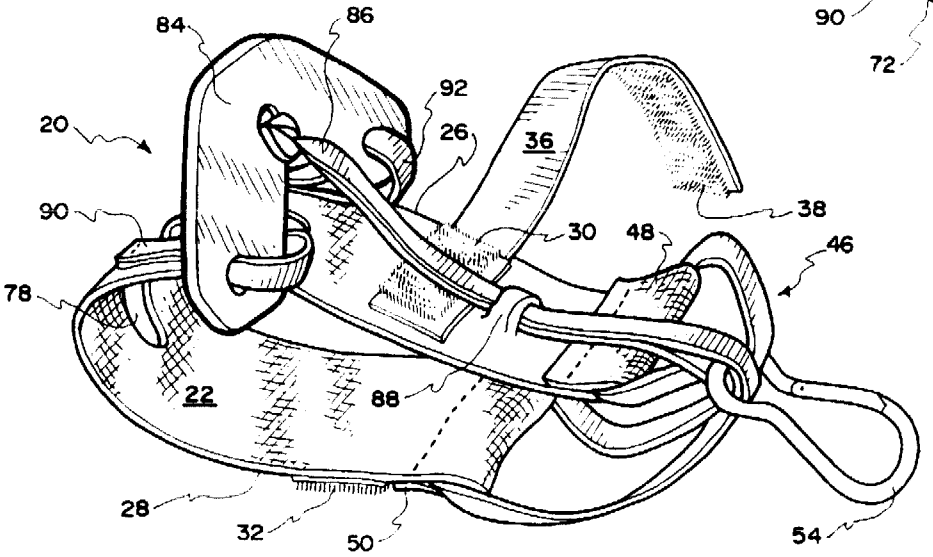
FIG. 7 is a perspective of the connector-removing device of FIG. 6 separated from a connector.
Figure 8:
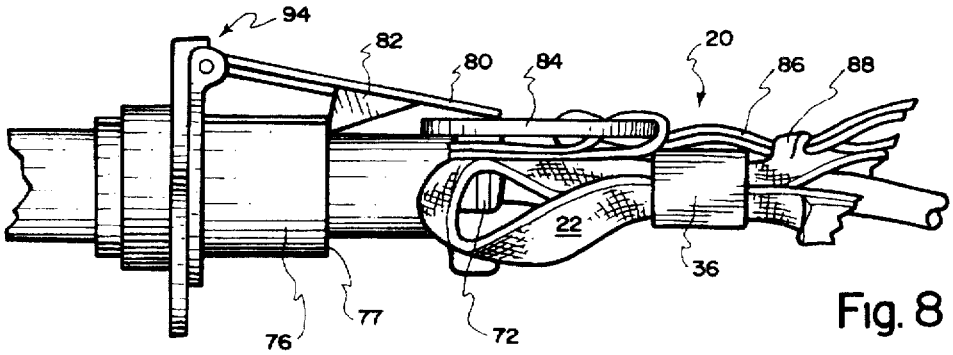
FIG. 8 is a side view of the connector-removing device of FIG. 6 inserted into a receptacle having a face cap with a latching hook thereon.
Figure 9:
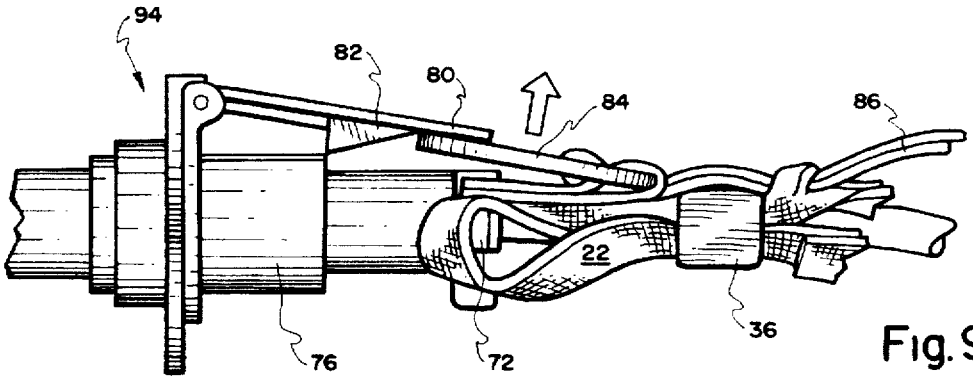
FIG. 9 is a side view of the connector-removing device of FIG. 6 and illustrates the lever lifting the face cap and latch away from the connector.
Figure 10:
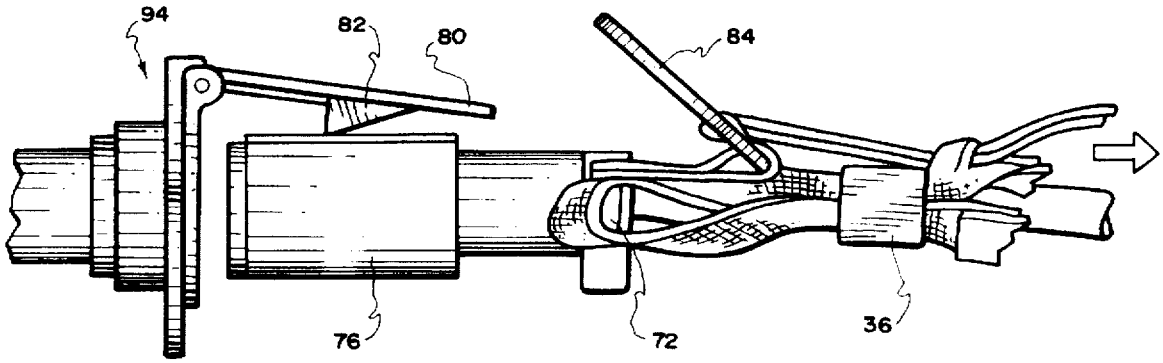
FIG. 10 is a side view of the connector-removing device attached to the finger lugs of a connector illustrating the connector disengaged from the receptacle.
Figure 12:
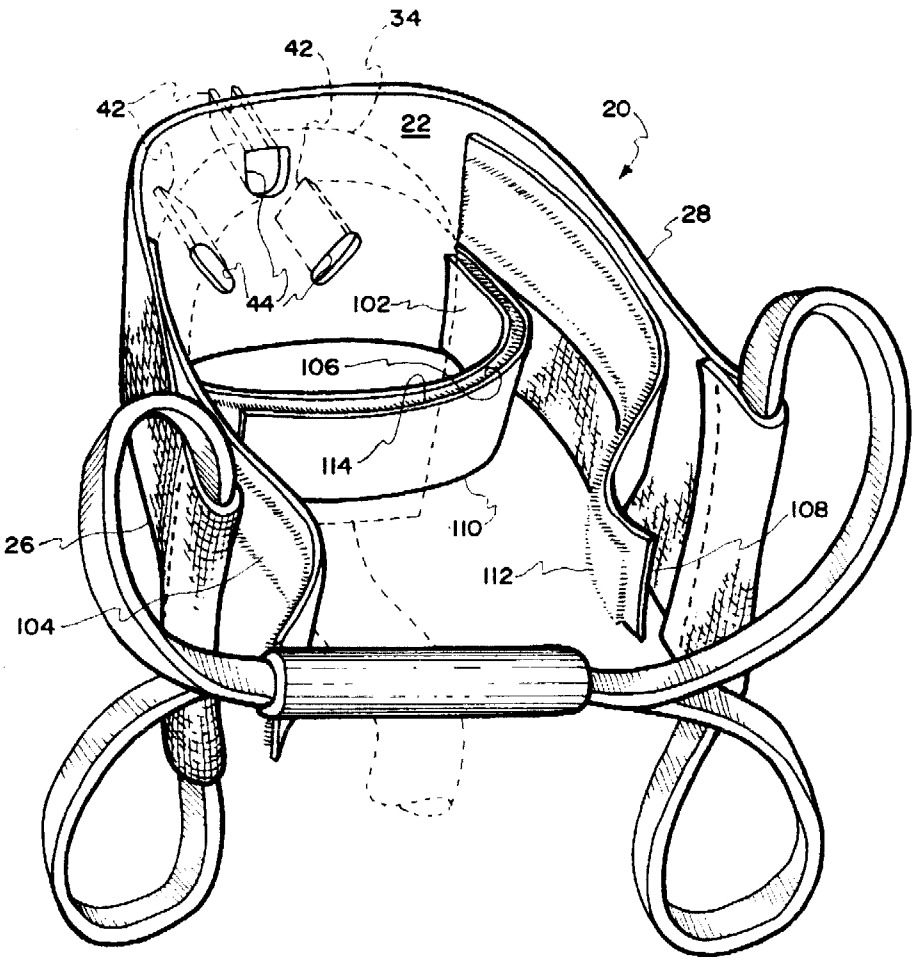
FIG. 12 is a perspective view of a connector-remover of the present invention having four fastening straps adapted for a three-phase power connector.
Figure 11:
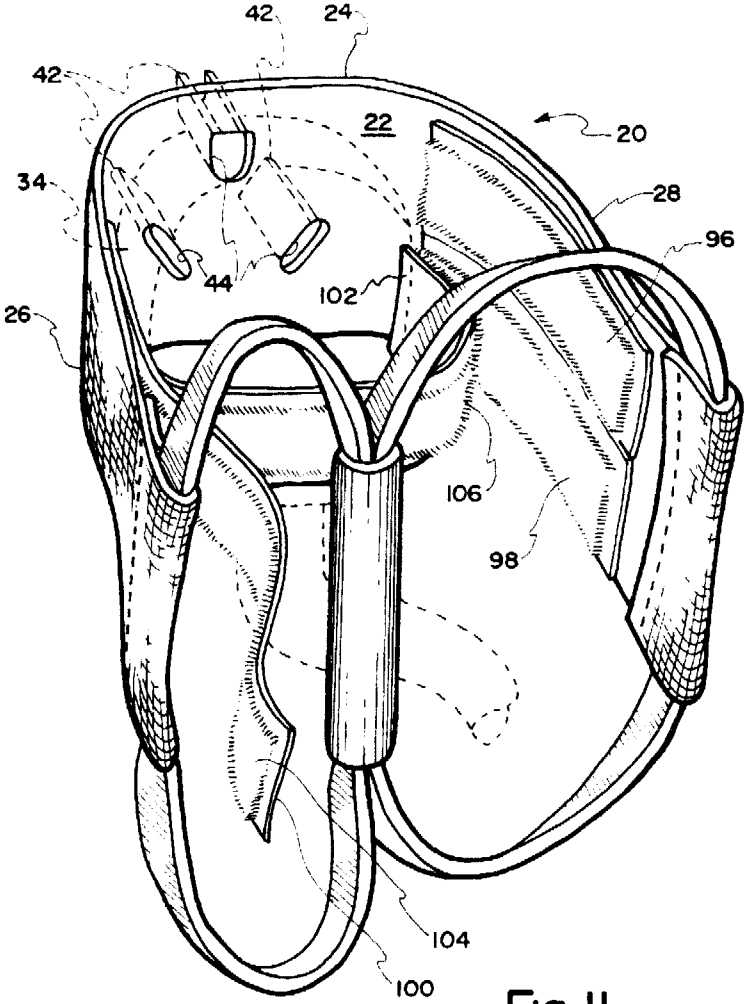
FIG. 11 is a perspective view of a connector of the present invention having two fastening straps adapted for a three-phase power connector.

Reference is now made to the drawings wherein like numerals are used to designate like parts throughout. FIG. 1 illustrates one embodiment of the present invention firmly secured to the male connector of an electrical cord. FIG. 2 illustrates the embodiment of FIG. 1 removed from the connector. FIG. 3 illustrates an embodiment of the present invention specifically designed for a six-pronged connector. FIG. 4 illustrates two devices of the embodiment illustrated in FIG. 3 with one being mounted on the male end and one being mounted on a female end of a two-cord connection. FIG. 5 illustrates an embodiment of the present invention in association with a male end and a female end of a two cord connection, wherein the embodiment mounted on the male end has a sleeve mounted thereon. FIG. 6 illustrates an embodiment of the present invention mounted on the finger lugs of a connector wherein the device has mounted thereon a lever for raising a face cap and latch of a receptacle. FIG. 7 illustrates the embodiment of FIG. 6 removed from the connector. FIGS. 8, 9, and 10 illustrate the removal of a connector from a receptacle having a face cap and latch by the embodiment of FIG. 6. FIGS. 11 and 12 illustrate embodiments of the present invention particularly adapted to accommodate a three-phase power connector.

FIGS. 1 and 2 show a first embodiment of a connector-remover apparatus generally designated 20. As shown in FIG. 2, the remover 20 comprises generally a band 22 which has a front portion 24 disposed between side portions 26 and 28. While the band is preferably formed of a synthetic fiber web, it may also be effectively made from any other suitable material, such as leather, synthetic material, and the like. The connector-remover further includes fasteners 30 and 32 affixed to the band side portions. Preferably, the band fasteners 30 and 32 are hook and loop type fasteners.

To firmly secure the connector-removing device 20 about a connector 34, a strap 36 is attached to either band side portion 26 or 28. Strap 36 has attached thereto a strap fastener 38. Preferably, the strap fastener is a hook and loop type fastener and may substantially cover at least one surface of the strap.

The remover 20 may be attached to a connector 34 by placing the band front portion 24 adjacent to a connector front portion 40. In the case of a male connector having prongs 42 extending therefrom, the prongs are preferably inserted through band apertures 44. Advantageously, the band apertures are formed in the band front portion 24 and are adapted to accept the prongs of a male connector. When mounted on a connector, the band side portions 26 and 28 extend away from the connector front portion 40 rearwardly. The strap 36 is then advantageously wrapped around the band side portions 26 and 28 and the strap fastener 38 is attached to the band fasteners 30 and 32 to firmly secure the connector within the remover.

Once connector-remover 20 is installed on a connector 34, the connector may be conveniently pulled from a receptacle 45 by pulling on tether 46 which is attached to the band side portions 26 and 28. Preferably, the tether is attached to the band side portions through stitched loops 48 and 50 formed on band side portions 26 and 28 respectively. The tether may comprise an endless cord 52 which is passed through the stitched loops formed in the band side portions. To maintain the loops of the tether together and to provide a convenient location from which to pull the connector-remover, a tether grip 54 is provided. Alternatively, the loops could be stitched together.

FIGS. 3 and 4 illustrate a second embodiment of the present invention. FIG. 3 generally illustrates the connector-remover 20. The remover generally comprises a band 22 having a band front portion 24. The band front portion has apertures 44 formed therein and arranged so that this embodiment may be effectively employed with a six-pronged connection. Additionally, the connector-remover has band side portions 26 and 28 to which are affixed band fasteners 30 and 32 respectively. Preferably, the band fasteners are made of hook and loop type fastening material. Also attached to band side portion 26 is a strap 36. The strap has a fastener 38 attached thereto which is also preferably made of a hook and loop type fastening material. Further, it is advantageous that the strap fastener substantially cover a surface of the strap.

To facilitate the pulling of the connector-remover 20, a tether 46 may be attached to the band side portions 26 and 28 of the connector-remover 20. It is preferable that the tether be attached to the band 22 by passing it through stitched loops 48 and 50 formed in the band side portions 26 and 28 respectively. Advantageously, the tether may comprise an endless cord 52. The loops of the endless cord may be secured and maintained together by passing them through a tether grip 54 or by stitching them together. Further, the tether grip 54 may comprise an elongated tube. The tether grip provides the user a convenient location from which to pull the connector-removing device.

FIG. 4 illustrates the connector-remover of FIG. 3 attached to both the male and female ends of a two-connector connection. The connector-remover 20 may be effectively employed both on the male connector 56 and the female connector 58. Each connector is securely held within its removing device by having the band 22 pass across the front portion 40 of the connector and then extend away from the front of the connector along the sides of the connector. To secure the connector-remover to the connector, a strap 36 is wrapped around the side portions 26 and 28 of the band and fastened to the band by at least one band fastener 30 or 32. The two-connector connection may be disconnected by the user by gripping a tether grip in each hand and pulling the tether grips in substantially opposite directions.

FIG. 5 illustrates a third embodiment of the present invention which is particularly useful in outdoor applications. In this embodiment, the female connector 58 is disposed within a connector-remover 20 which comprises a band 22 having a band front portion 24 disposed between band side portions 26 and 28. The band front portion preferably has aperture 44 therethrough adapted to accept the prongs of a connector. To secure the female connector within the connector-remover, a strap 36 having attached thereto a strap fastener 38 is attached to band side portion 26. The band side portions 26 and 28 also have attached thereto band fasteners 30 and 32 respectively. An additional feature of this embodiment is the presence of outer fasteners 60 which may be attached to the band side portions 26 and 28. An outer fastener 60 may be effectively fastened to the sleeve inner fastener 66 to provide for additional securement of the sleeve 62 about the two-cord connection. The band front portion 24 has formed therein band apertures 44 which are oriented to receive the prongs of male connector 56. Preferably, the band fasteners, strap fastener, outer fasteners, and sleeve inner fastener comprise hook and loop type fasteners.

Both connector-removers illustrated in FIG. 5 have attached thereto a tether 46. The tether 46 is preferably attached to the band side portions 26 and 28 of the respective removers by passing a cord 52 through stitched loops 48 and 50 respectively. Additionally, the tether cords are preferably held together by a tether grip 54, which may be a clip.

The connector-remover shown disposed on the male connector 56 includes a band 22 having a front portion 24, the front portion having band apertures 44 formed therein adapted to receive the connector prongs 42 of male connector 56. Further, the band has attached thereto on side portion 26 a strap 36. This strap has a strap fastener 38 which may substantially cover one surface of the strap. Additionally, the band side portions 26 and 28 have mounted thereon band fasteners 30 and 32 respectively. The band fasteners and the strap fastener preferably comprise hook and loop type fasteners.

In order to protect the prongs 42 of male connector 56 from the elements and to provide substantial enclosure for the two-connector connection, a sleeve 62 is attached to the strap 36 and extends from the strap forwardly toward the band front portion 24 and continues to extend past the band front portion a distance sufficient to encompass the connector prongs 42. The sleeve preferably has attached thereto on its outer surface a sleeve fastener 64. The sleeve fastener is disposed on the outer surface of the sleeve so that the strap fastener 38 may engage with the sleeve fastener when wrapped around the band side portions 26 and 28 to firmly secure the connector within the connector-remover 20. It is preferable that the sleeve fastener 64 comprise hook and loop type fastening material.

The sleeve 62 also has a sleeve inner fastener 66 attached to the inner surface 63 of the sleeve. The sleeve inner fastener is provided to fasten with the outer fastener 60 disposed on the remover disposed on female connector 58 to further secure the two-connector connection. Additionally, to reduce the diameter of the sleeve so that it snugly covers the connector 56, two pairs of fasteners are preferably attached to the sleeve. The first diameter-reducing pair of fasteners 68 are preferably attached to the outer surface of the sleeve 62 adjacent to the end of the sleeve opposite strap 36. Preferably, fasteners 68 comprise a pair of magnets of opposite polarity such that they attract one another. Having magnets serve as fasteners is advantageous in that they may be joined by their coming into relative proximity with one another instead of having to be fastened by hand. To further aid in the joining of fasteners 68, a coupler 69 is attached to the sleeve outer surface and passes through aperture 71 and extends from the sleeve. Attached to the end of the coupler opposite its attachment to the sleeve is fastener 73. Fastener 73 may be fastened to either fastener 60 whereby when connectors 56 and 58 are pulled apart, the tensioned coupler will tend to pull the fasteners into relative proximity.

Additionally, a second pair of diameter-reducing fasteners 70 are preferably disposed on the outer surface of the sleeve between fastener pair 68 and strap 36. Fastener pair 70 provides substantial closure of the sleeve and can be used to reduce sleeve diameter so that it snugly fits over the two-connector connection. Advantageously, fasteners 70 comprise hook and loop type fasteners.

The connector-remover device illustrated in FIG. 5 may be effectively employed in the context of an electric block heater for a car engine. The connector 56 may represent a connector on an electric block heater and the clip 54 may be effectively attached to the grill of an automobile. Further, the clip 54 associated with female connector 58 may be connected to another object. Thus, disconnection of female connector 58 from male connector 56 may be accomplished merely by moving the car away from the object to which clip 54 of the female connector is attached thereby pulling the male connector from the female connector. Once removed from the female connector, the shaking and bouncing associated with driving an automobile will tend to close the magnetic pair of fasteners 68 (if not previously joined by the tensioning of coupler 69), thus providing substantial protection for the prongs 42 from the elements.

FIGS. 6 through 10 illustrate a fourth embodiment of the present invention which may be effectively employed on a connector 76 having finger lugs 72 and 74 (not shown). Further, it is particularly advantageous for use in situations where the receptacle has a face cap 80 with a latch 82 thereon.

The remover 20 is comprised of a band 22 having an aperture 78 disposed therein, the aperture being sized to accept a connector 76 therethrough. The band has mounted thereon band side fasteners 30 and 32 disposed on band side portions 26 and 28 respectively. Also attached to band side portion 26 is a strap 36 having a strap fastener 38 disposed thereon. When fastened to a connector, the strap is wrapped around the band side portions and is preferably connected with the band fasteners 30 and 32. The strap fastener and band fasteners are preferably made of hook and loop type fastening material. A tether 46 is provided to assist the user in pulling the connector from the socket. The tether is preferably connected to the band side portions by stitched loops 48 and 50 formed in the band side portions 26 and 28 respectively. To keep the tether cords together and to provide a convenient location from which to pull the connector, a tether grip 54 is provided.

To assist the user in removing a connector 76 from a receptacle 94 having a spring loaded face cap 80 with a latch 82 disposed thereon, a lever 84 is provided. The lever is pivotally attached to the band by lever couplings 90 and 92 which are securely attached to the band. The lever further has a lever tether 86 attached thereto which passes through lever tether coupling 88. Thus, the lever may be selectively pivoted relative to the band 22 by pulling the lever tether 86. Preferably, the lever tether is also attached to the tether grip 54 such that pulling on the tether grip causes the lever to pivot.

FIG. 8 illustrates a connector 76 having a connector ridge portion 77 disposed in a socket 94 having a spring loaded face cap 80 with a latch 82 provided thereon. The face cap/latch assembly is provided to engage with the ridge portion of the connector to keep the connector securely disposed within the receptacle until its removal is desired. The remover 20 is illustrated as being attached to finger lugs 72 and 74 (not shown) and securely fastened by strap 36. Lever 84 is shown to be inserted between the face cap 80 and connector 76. Additionally, the lever tether 86 is shown being connected to the lever and passing through a lever tether coupling 88.

FIG. 9 shows the connector 76 being removed from receptacle 94 by the pulling of tether 86 which is attached to lever 84. As illustrated, upon pulling lever tether 86 in a direction substantially opposite the receptacle 94, the lever 84 is caused to pivot upwardly, thus raising the spring-loaded face cap 80 and releasing the connector from the latch 82. FIG. 10 illustrates the connector 76 removed from the receptacle by the pulling of the lever tether in a direction substantially opposite from the socket.

In operation, a connector 76 may be removed from a receptacle 94 by affixing a connector-remover 20 to the connector, the connector-remover generally comprising a band 22, a lifting lever 84 pivotally attached to the band, and a lever tether 86 attached to the lifting lever. The lifting lever should be positioned between the receptacle face cap 80 and the connector 76. To remove the connector, the lever tether is pulled in a direction substantially opposite the receptacle which causes the lever to pivot relative to the band and to displace the face cap relative to the connector. Once the face cap is displaced, the connector may be effectively removed from the socket by pulling the connector-remover. The connector may be removed by pulling either the band 22 directly, or by pulling a band tether 46 attached to the ends of the band.

FIGS. 11 and 12 illustrate additional embodiments of the present invention which are particularly useful for securing and pulling a connector whose prongs or apertures for receiving prongs are substantially perpendicular to the longitudinal axis of the connector housing, such as a three-phase power connector. As illustrated in FIG. 11, the connector-removing device 20 generally comprises a band 22 having a front portion 24 disposed between side portions 26 and 28. A connector 34 is illustrated as being disposed within the connector-remover and has prongs 42 which extend through apertures 44 formed in the band front portion adapted to accept connector prongs.

The band 22 has disposed on its side portion 28, fasteners 96 and 98, which are preferably hook and loop type fasteners. These fasteners are used to secure the connector 34 securely within the connector-remover 20. Fastening straps 100 and 102 are attached to band side portion 26 and have strap fasteners 104 and 106 disposed thereon.

In operation, to secure connector 34 within connector-remover 20, prongs 42 are inserted through apertures 44 formed in the band front portion 24. Strap fasteners 104 and 106, are then attached to connectors 96 and 98 respectively to firmly hold the connector within the connector-removing device.

Similarly, in FIG. 12, a connector-removing device 20 is illustrated as having a connector 34 having prongs 42 extending therefrom. The prongs 42 are inserted through apertures 44 formed in the band 22. In this embodiment, the straps 100 and 102, having strap fasteners 104 and 106 respectively secured thereon, are affixed to the band side portion 26. Moreover, affixed to band side portion 28 are straps 108 and 110 having strap fasteners 112 and 114 respectively attached thereto. To secure the connector within the connector-remover 20, straps 100 and 102 are snugly positioned against connector 34. Then, connectors 112 and 114 are connected with fasteners 104 and 106 respectively, to firmly hold the connector within the connector-remover.

The invention may be embodied in other specific forms without departing from the spirit of essential characteristics thereof. The present embodiments therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A connector-remover apparatus comprising:

a band having a front portion disposed between a pair of opposed side portions, at least one aperture disposed in the front portion adapted to accept prongs of a connector;

a band fastener affixed to one of the two band side portions;

at least one strap affixed to one of the two band side portions, the strap comprising at least one strap fastener attached thereto for securely positioning the connector between the two opposed band side portions by the strap wound around the connector and attached to the band by fastening the strap fastener to the band fastener.

2. A connector-remover apparatus according to claim 1 wherein the band fastener and the strap fastener comprise hook and loop fasteners.

3. A connector-remover apparatus according to claim 1 further comprising a tether attached to ends of the band to facilitate pulling the apparatus.

4. A connector-remover apparatus according to claim 3 further comprising a tether grip connected to the tether.

5. A connector-remover apparatus according to claim 1 further comprising:

a stitched loop formed at each end of the band;

a tether passing through the stitched loops to facilitate application of tension to the apparatus.

6. A connector-remover apparatus according to claim 1 further comprising:

a sleeve affixed to the strap, the sleeve being sized to substantially enclose the prongs of a male connector disposed between the band side portions when the strap is wrapped around the band side portions.

7. A connector-remover apparatus according to claim 6 wherein the sleeve comprises an outer surface and a diameter and further comprising at least one pair of exposed fasteners carried by the sleeve by which the diameter of the sleeve is decreased by fastening at least one pair of fasteners to each other.

8. A connector-remover apparatus according to claim 7 wherein at least one exposed fastener carried by the sleeve comprises a magnet.

9. A connector-remover apparatus according to claim 7 wherein the sleeve has an aperture therethrough and further comprising a coupler attached at one end to the sleeve outer surface, the coupler comprising a fastener attached to the other end of the coupler, the coupler passing through the sleeve aperture for bringing the exposed fasteners carried by the sleeve into relative proximity by the tensioning of the coupler.

10. A connector-remover apparatus according to claim 7 wherein the pair of exposed fasteners carried by the sleeve comprise hook and loop fasteners.

11. A connector-remover apparatus according to claim 6 wherein the sleeve comprises an inner surface and a fastener attached to the inner surface of the sleeve for fastening the sleeve to another connector-remover apparatus comprising a fastener carried by the connector-remover apparatus.

12. A connector-remover apparatus according to claim 1 further comprising a plurality of straps which are affixed to at least one of the two band side portions, each strap comprising at least one strap fastener attached thereto for securely positioning the connector between the band side portions by the strap being wrapped around the connector and attached to the band by fastening the strap fastener to the band fastener.

13. A connector-remover apparatus for disconnecting a connector inserted in a receptacle having a face cap comprising:

a band having a front portion disposed between a pair of side portions;

a discrete lever pivotally affixed to at least one side portion by at least one lever coupling;

a lever tether affixed to the lever for pivoting the lever relative to the connector by pulling the lever tether, a lever tether coupling on one of the band side portions, the lever tether passing through and being slidably engaged with the lever tether coupling to maintain the lever tether coupled to the band.

14. A connector-remover apparatus for disconnecting a connector inserted in a receptacle having a face cap comprising:

a band having a front portion disposed between a pair of side portions;

a lever pivotally affixed to at least one side portion:

a lever tether affixed to the lever for pivoting the lever relative to the connector by pulling the lever tether:

at least one band fastener disposed on the band;

a strap affixed to at least one side portion;

at least one strap fastener carried by the strap to securely hold a connector positioned between the band side portions by fastening the strap fastener to the band fastener.

15. A connector-remover apparatus for disconnecting a connector inserted in a receptacle having a face cap comprising:

a band having a front portion disposed between a pair of side portions;

a lever pivotally affixed to at least one side portion a lever tether affixed to the lever for pivoting the lever relative to the connector by pulling the lever tether;

a band tether attached to ends of the band, the tether interconnecting the ends of the band to facilitate pulling the connector.

16. A connector-remover apparatus according to claim 15 wherein the band tether and the lever tether are attached to a tether grip.

17. A method of removing a connector from a receptacle having a face cap pivotally attached to the receptacle, comprising the steps of:

providing a connector-remover comprising:

a band;

a discrete lifting lever pivotally attached to the band;

a lever tether attached to the lifting lever;

affixing the connector-remover to the connector;

positioning the lifting lever between the face cap pivotally attached to the receptacle and the connector;

pivoting the face cap away from the connector by pulling on the lever tether;

applying tension to the connector-remover to pull the connector from the receptacle.

18. A method of removing a connector according to claim 17 wherein the applying step is accomplished by pulling on the band.

19. A method of removing a connector from a receptacle having a face cap, comprising the steps of:

providing a connector-remover comprising:

a band, a lifting lever pivotally attached to the band, a lever tether attached to the lifting lever, affixing the connector-remover to the connector, positioning the lifting lever between the receptacle face cap and the connector, displacing the face cap by pulling the lever tether causing the lever to pivot and displace the face cap relative to the connector, applying tension to the connector-remover by pulling on a band tether attached to the ends of the band to pull the connector from the receptacle;.

20. A method of affixing a connector-remover apparatus to a connector having prongs, comprising the steps of:

providing a connector-remover apparatus comprising:

a band having a plurality of apertures therethrough;

a strap attached to the band;

inserting the prongs of a connector into the band apertures;

wrapping the strap around the connector and the band;

fastening the strap to the band.

21. The method of claim 20 wherein the band and the strap have fasteners disposed thereon, the step of fastening further comprising:

fastening a fastener disposed on the strap to a fastener disposed on the band.

* * * * *